United States Patent [19]

MacGlashan, Jr.

[11] 4,228,656

[45] Oct. 21, 1980

[54] POWER CONTROL FOR HOT GAS ENGINES

[76] Inventor: Robert A. Frosch, Administrator of the National Aeronautics and Space Administration, with respect to an invention of William F. MacGlashan, Jr., Arcadia, Calif.

[21] Appl. No.: 907,421

[22] Filed: May 19, 1978

[51] Int. Cl.[3] ..... F02G 1/06

[52] U.S. Cl. ..... 60/518; 74/417

[58] Field of Search ..... 60/518, 522, 700; 74/417, 713, 665 A, 665 C

[56] References Cited

U.S. PATENT DOCUMENTS

| | | | |
|---|---|---|---|
| 2,465,139 | 3/1949 | Van Weenen et al. | 60/518 |
| 2,508,315 | 5/1950 | Van Weenen et al. | 60/518 |
| 3,192,789 | 7/1965 | Savage | 74/385 |
| 3,315,465 | 4/1967 | Wallis | 60/518 |
| 3,416,308 | 12/1968 | Livezey | 60/518 |
| 3,457,722 | 7/1969 | Bush | 60/522 |

*Primary Examiner*—Allen M. Ostrager
*Assistant Examiner*—Stephen F. Husar
*Attorney, Agent, or Firm*—Monte F. Mott; John R. Manning; Wilfred Grifka

[57] ABSTRACT

A hot gas engine in which the expander piston of the engine is connected to an expander crankshaft. A displacer piston of the engine is connected to a separate displacer crankshaft which may or may not be coaxial with the expander crankshaft. A phase angle control mechanism used as a power control for changing the phase angle between the expander and displacer crankshaft is located between the two crankshafts. The phase angle control mechanism comprises a differential-type mechanism comprised of a pair of gears, as for example, bevel gears, one of which is connected to one end of the expander crankshaft and the other of which is connected to the opposite end of the displacer crankshaft. A mating bevel gear is disposed in meshing engagement with the first two bevel gears to provide a phase-angle control between the two crankshafts. Other forms of differential mechanisms may be used including conventional spur gears connected in a differential type arrangement.

25 Claims, 8 Drawing Figures

POWER CONTROL FOR HOT GAS ENGINES

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 USC 2457).

BACKGROUND OF THE INVENTION

1. Purpose of the Invention

This invention relates in general to certain new and useful improvements in a power control for hot gas engines, and, more particularly, to differential-type mechanism power controls for hot gas engines which adjust the phase angle between a displacer section and the expander section of the engine.

2. Brief Description of the Prior Art

Hot gas engines, often referred to as "Stirling" engines, have been known for a long period of time. Generally, the Stirling engine comprises a pair of pistons, including an expander piston and a displacer piston, both of which are connected to a single crankshaft. A heat exchanger is connected between the expander portion of the engine and the displacer portion of the engine. In the expander portion of the engine, hot gas is expanded and converts heat energy into power, so that the overall engine produces a useful power output. The displacer portion of the engine utilizes some of the power from the crankshaft to compress a cool, working gas, thereby generating a net power output from the engine.

The typical Stirling engine is constructed so that a fixed and predetermined phase angle exists between the expander power piston and the displacer piston in the engine. When the phase angle between the displacer piston and the expander power piston is 0°, there is no power output from the engine. Increases in a positive direction of the phase angle between the displacer piston and the expander piston results in a net forward power output from the engine. Correspondingly, a phase angle change in the opposite direction results in a net reverse power output. Thus, at a full 90° phase angle difference between the expander piston and the displacer piston, full forward power is obtained, and with a −90° phase angle between the expander piston and the displacer piston, full reverse power is obtained from the engine. In this way, it is possible to control the engine's power output and also to change the output to a forward or reverse direction.

There have been many proposed devices to change the phase relationship between the expander portion and the displacer portion of the Stirling engine. In general, a relatively large amount of power is required to overcome the reaction forces acting between the displacer portion and the expander portion of the Stirling engine. The power requirements of any mechanism to change the power rating of the engine affects the normal power transmitting ability. Thus, any mechanism to change the phase between the expander portion and the displacer portion must meet various power requirements with minimum torque and speed levels. In addition, the size, weight and cost of the mechanism to change the phase between the expander portion and the displacer portion must be kept at a minimum. It has been well recognized that an efficient and simple mechanism for changing the phase between the expander portion and the displacer portion of the Stirling engine in order to vary engine power output and drive direction will significantly increase the efficiency of the engine and lend to added commercial application thereof.

There have been several proposed phase changing devices in the prior art, as for example, that illustrated in U.S. Pat. No. 3,315,465 to Wallis in which a variable ratio transmission is connected in a single in-line crankshaft constituting a part of the power train of the engine. The expander piston of the engine operates on the crankshaft and the displace piston is operable thereby. Another form of control device for use with a hot gas engine is disclosed in U.S. Pat. No. 3,416,308 to Livezey which employs a complex planetary gear arrangement, including concentric drive shafts and a servo motor required to enforce the changed phase relationship. A further form of phase change control device for use with a hot gas engine is disclosed in U.S. Pat. No. 2,508,315 to Van Weenen et al. In this case, the crank shaft operates in a vertical plane, and the change in phase relationship is accomplished by a lever and wormgear type arrangement. U.S. Pat. No. 2,465,139 to Van Weenen et al also discloses a phase change device for use with a hot gas engine in which the phase changer comprises an eccentric located on a rod arranged inside of a hollow crank shaft. In addition, U.S. Pat. No. 3,192,789 to savage discloses a bevel gear arrangement for transmission of power between shaft portions which are parallel but not coupled in the same plane.

Each of these aforementioned phase changing devices which are used with hot gas engines are relatively complex in their construction, thereby increasing the cost of manufacture and also with a resultant decrease in efficiency of operation. Moreover, each of these devices are large in size and impose considerable weight. Furthermore, and more importantly, a large amount of power is required to operate each one of the aforementioned phase changing devices.

OBJECTS OF THE INVENTION

It is, therefore, the primary object of the present invention to provide a power control device for changing the effective phase angle between an expander portion and a displacer portion of a hot gas engine, which utilizes a relatively simple differential arrangement, operating in conjunction with an expander crankshaft and a separate displacer crankshaft.

It is another object of the present invention to provide a power control of the type stated, which can be effectively utilized while the engine is operating and without interfering with the thermodynamic cycle of the engine.

It is also an object of the present invention to provide a power control device of the type stated which comprises a first gear rotatable with the expander crankshaft and a second gear rotatable with the displacer crankshaft and operable gear means shiftable with respect to the first and second gear causing a phase change between the expander and displacer crankshafts.

It is a further object of the present invention to provide a hot gas engine having a separate expander crankshaft and a separate displacer crankshaft with an effective phase angle control mechanism operating on both crankshafts and in which heat input to the engine varies primarily in accordance with the power output.

It is an additional object of the present invention to provide a hot gas engine of the type stated which allows the engine to operate at full pressure and temperature for maximum efficiency and at any speed and power output.

With the above and other objects in view, my invention resides in the novel features of form, construction, arrangement and combination of parts presently described and pointed out in the claims.

BRIEF SUMMARY OF THE DISCLOSURE

This invention relates to a power control for changing the effective phase angle between the expander portion and the displacer portion of a hot gas engine, as, for example, a Stirling engine. The name "Stirling" engine is often applied with respect to all types of regenerative engines, including both rotary and reciprocating engines utilizing mechanisms of varying complexity. This name is also used to cover engines which are capable of operating as prime movers, heat pumps, refrigerating engines, and pressure generators. However, for the purposes of this disclosure, it will be understood that the Stirling engine is an engine which operates on a closed, regenerative thermodynamic cycle. This thermodynamic cycle includes cyclic compression and expansion of the working fluid at different temperature levels, and where the fluid flow is controlled by volume changes, so that there is a net conversion of heat to work or vice versa. Generally this definition as applied to this type of Stirling engine is more fully discussed in "Stirling Cycle Machines" by G. Walker, Clarendon Press, Oxford, 1973.

The conventional Stirling engine normally includes at least one expander cylinder with a reciprocatively shiftable expander piston therein and one displacer cylinder with a reciprocatively shiftable displacer piston therein, and both of which are connected through connecting rods to a single crankshaft. A heat exchanger usually including a series connected heater, regenerator and cooler, is connected between the expander cylinder and the displacer cylinder. However, in accordance with co-pending application Ser. No. 907,431 filed May 19, 1978, it has been found that a Stirling engine can operate with a displacer piston connected to a displacer crankshaft and an expander piston connected to a separate expander crandshaft.

In accordance with the present invention, a first gear is connected to the displacer crankshaft and a second gear is connected to the expander crankshaft when both the displacer crankshaft and the expander crankshaft are in coaxial alignment. The first and second gears are connected in proximity to the opposed ends of the two crankshafts. A shiftable gear means is located in meshing engagement with the first and second gears and permits displacement between the crankshafts when the gear means is moved, causing relative movement between the first and second gears, and hence the displacer crankshaft and the expander crankshaft.

One or both of the crankshafts could serve as or otherwise be connected to a power output shaft from the Stirling engine. When the phase relationship between the displacer crankshaft and the expander crankshaft is zero, then the net power output of the engine is zero power. However, when the phase relationship between the expander crankshaft and the displacer crankshaft is increased in a positive direction, a forward power output results and conversely, when the phase angle between the displacer crankshaft and the expander crankshaft is increased in a negative direction, a reverse power output is obtained from the Stirling engine. At a full positive 90° phase angle differential, full forward power is obtained from the engine, and at a full minus 90° phase angle between the two crankshafts, a full reverse power output is obtained from the Stirling engine.

Generally, any differential type gear mechanism is effective as the phase changer of the present invention. In one embodiment of the invention, the first and second gears are bevel gears and will normally rotate with the displacer crankshaft and the expander crankshaft. Moreover, each of these crankshafts will rotate in opposite directions relative to one another. The movable gear means in this case is a third bevel gear which is disposed in meshing engagement with the first and second gears and will also simultaneously rotate with the first and second gears. In this respect, the first and second gears have the same size and the same number of teeth so as to create no phase angle change between the two crankshafts when the third bevel gear remains in a stationary position.

In order to change the phase angle between the displacer crankshaft and the expander crankshaft, the third bevel gear is shifted in an arcuate path relative to the axis of rotation to the two crankshafts. The arcuate path of movement of the third bevel gear is essentially defined by a centerpoint coincident with the axis of rotation of the first and second crankshafts and having a radius which is greater than the radius of the first and second crankshafts.

Thus, when the third gear is shifted in a first direction relative to the axis of rotation of the two crankshafts, a phase angle change is created, thereby generating a positive power output from the engine. Conversely, when the third gear is shifted in the opposite direction relative to the axis of rotation of the two crankshafts, a negative phase angle change is created, thereby providing a reverse power output from the engine.

In another embodiment of the present invention, the differential type gear mechanism comprises a first gear on and rotatable with the expander crankshaft and a second gear on and rotatable with the displacer crankshaft. The first and second gears may be in the form of pinion or spur gears. The movable gear means comprises a third gear in meshing engagement with either the first or second gears, e.g. the second gear on the displacer crankshaft, for example. A fourth gear is slightly spaced from the first gear and cooperates therewith through a fifth gear or idler gear disposed in meshing engagment with the first and fourth gears. The third and fourth gears are connected together by a common shiftable shaft. Thus, when the shiftable shaft is moved in an arcuate path about the two crankshafts, the phase angle between the expander and displacer portions of the engine will be changed.

The crankshafts do not have to be co-axial with the differential type mechanisms of the present invention. A suitable gearing arrangement could be employed to enable the first and second gears to be located on shafts which are not in co-axial alignment. It is generally desirable for the first and second gears to be mounted on shafts which are in co-axial alignment.

In a more commercially effective type power control, the differential type mechanisms will be mounted in a housing which is rotatable with respect to the expander and displacer crankshafts.

This invention possesses many other advantages, and has other purposes which may be made more clearly apparent from a consideration of forms in which it may be embodied. These forms are shown in the drawings accompanying and forming part of the present specification. They will now be described in detail, for the purpose of illustrating the general principles of the invention; but it is to be understood that such detailed descriptions are not to be taken in a limiting sense.

BRIEF DESCRIPTION OF THE DRAWINGS

Figure 1:
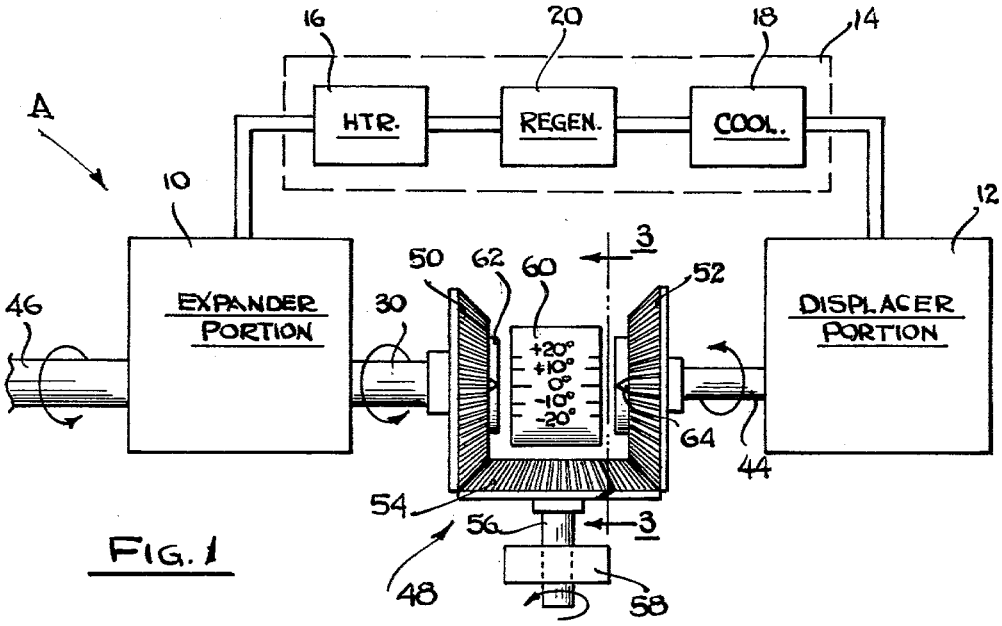
Figure 2:
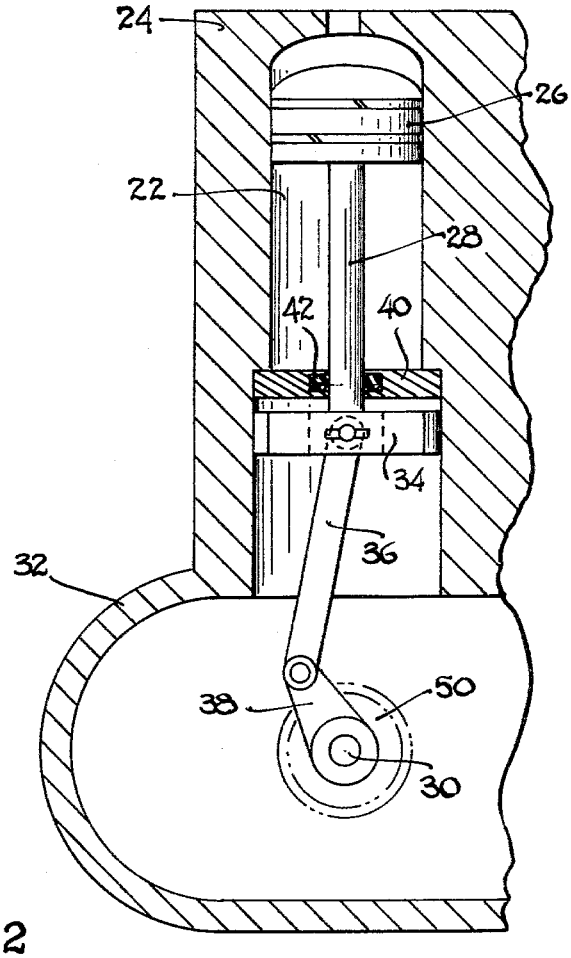
Figure 3:
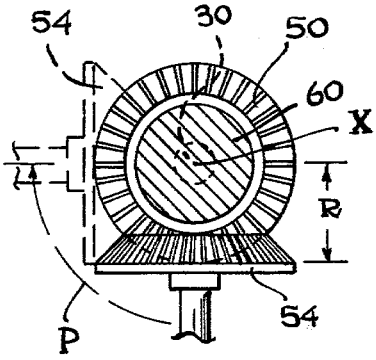
Figure 4:
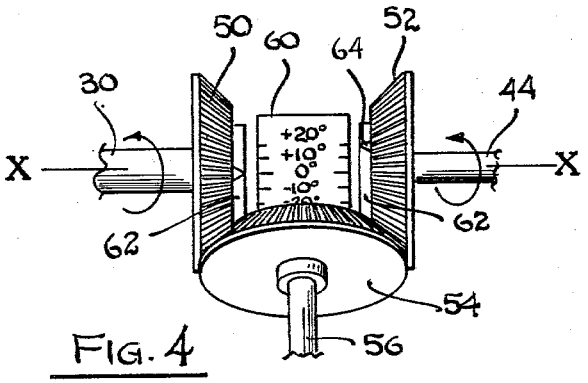
Figure 5:
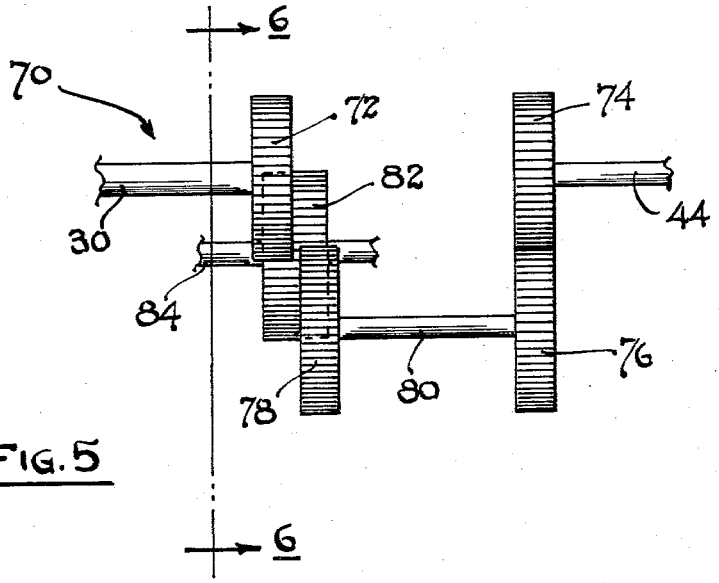
Figure 6:
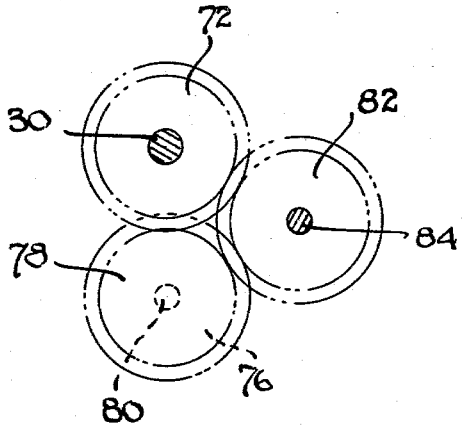
Figure 7:
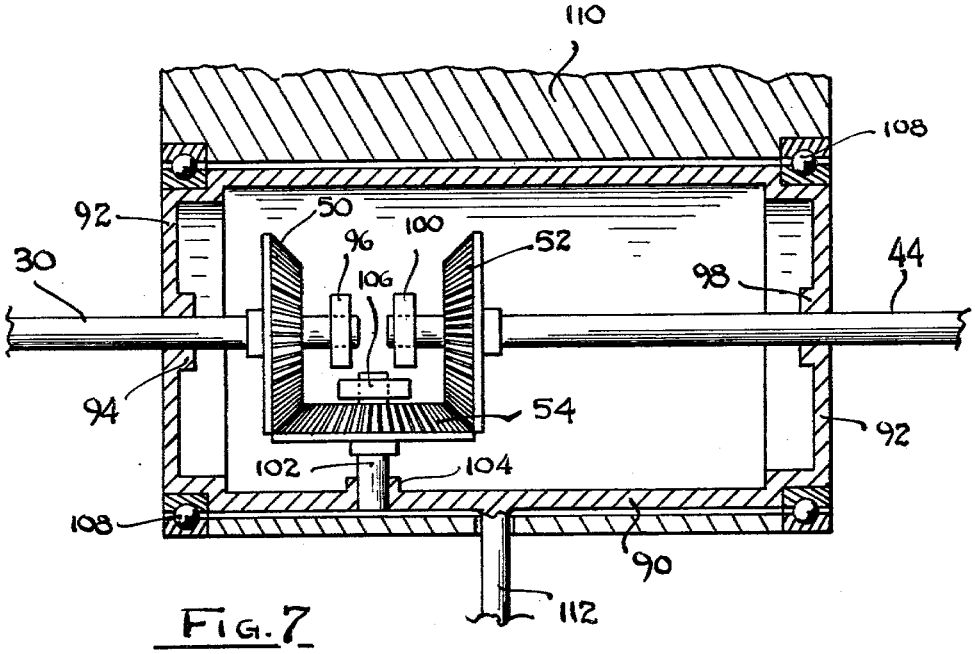
Figure 8:
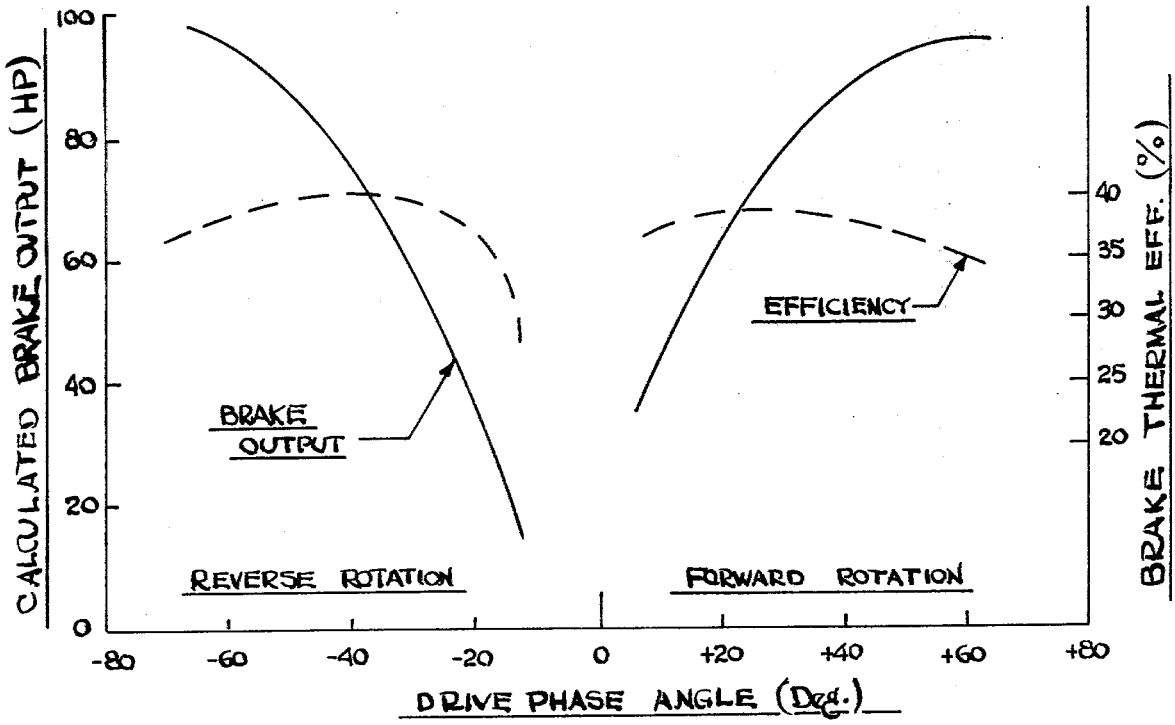

Having thus described the invention in general terms, reference will now be made to the accompanying drawings in which:

FIG. 1 is a schematic view showing a Stirling engine having dual crankshafts provided with a phase changing control device in accordance with the present invention;

FIG. 2 is a schematic vertical sectional view, partially broken away, and showing one of the pistons connected to a crankshaft in accordance with the Stirling engine of the present invention;

FIG. 3 is an end elevational view showing a portion of the phase angle control device of the present invention, taken substantially along line 3—3 of FIG. 1;

FIG. 4 is a side elevational view, partially broken away, and showing the phase angle control device of the present invention when shifted to a position where a Stirling engine will provide a positive power output;

FIG. 5 is a side elevational view, partially broken away, and showing a portion of a modified form of phase angle control device of the present invention;

FIG. 6 is an end elevational view, substantially taken along line 6—6 of FIG. 5;

FIG. 7 is a side elevational view, partially broken away and in section, and showing a more commercially effective embodiment of a phase angle control device in accordance with the present invention; and FIG. 8 is a diagrammatic view of a plot showing the performance characteristics for a variable phase angle Stirling engine.

DETAILED DESCRIPTION OF PREFERRED EMBODIMENTS

Referring now in more detail and by reference characters to the drawings which illustrate preferred embodiments of the present invention, A designates a Stirling engine having the power control mechanism in the form of the phase angle control mechanism of the present invention. The Stirling engine A comprises an expander portion 10 and a displacer portion 12 which are connected together by a conventional heat exchanger 14. The heat exchanger 14 includes a heater 16 connected to the expander portion, a cooler 18 connected to the displacer portion with a regenerator 20 connected in series therebetween in the conventional manner in hot gas engines.

The expander portion of the engine is more fully illustrated in FIG. 2 of the drawings and includes an expander cylinder 22 formed in an engine block 24 and having a reciprocatively shiftable expander piston 26 therein. The expander piston 26 is provided with a piston rod 28 which is integral with or which may otherwise be rigidly secured to the piston 26. The piston 26 and piston rod 28 cause rotation of an expander crankshaft 30 included in a crankcase 32 connected to the lower end of the engine block, in a manner hereinafter described.

The piston rod 28 is pivotally connected at its lower end to a connecting arm or so-called "connecting rod" 36 through a crosshead 34, the latter being of generally conventional construction. In essence, the piston rod 28 is vertically shiftable and the connection to the connecting arm 26 is a pivotal connection in the cross-head 34. The lower end of the connecting arm 36 is pivotally connected to a crank arm 38 which is, in turn, connected to the crankshaft 30 causing rotation of the same. The cross-head 34 is located within the skirt portion of the cylinder 22 to remove side load from the piston rod 28 and also to maintain axial alignment of the rod 28, and in this way, only an axial force component is transmitted by the piston 26 and piston rod 28. The cross-head 34 bears against the wall of the skirt portion in sliding engagement and shifts vertically with the piston rod 28. However, portions of the cross-head 34 are removed to prevent the same from functioning as a piston.

A conventional seal block 40 having a sealing ring 42 is located in the skirt portion of the cylinder 22 and the piston rod 28 extends therethrough. The seal block 40 is located immediately above the cross-head 34 and prevents oil in the crankcase from passing into the cylinder head and the heat exchanger 14. Furthermore, in the present invention, the crankcase 32 is maintained at the same pressure as the remaining portion of the system.

The displacer portion 12 is essentially identical in construction and therefore has been neither illustrated nor described in any further detail herein. However, it should be observed that the displacer piston would be connected to a displacer crankshaft 44, much in the same manner as the expander piston 26 is operatively connected to the expander crankshaft 30. Furthermore, the displacer piston would be driven by the crankshaft 44 as opposed to driving the crankshaft.

In the arrangement as illustrated, the expander crankshaft 30 and the displacer crankshaft 44 are both in co-axial alignment. Moreover, one of the crankshafts, such as the expander crankshaft 30, could also serve as a power output shaft, or otherwise would be connected to a power output shaft 46, in the manner as illustrated in FIG. 1 of the drawings. However, the two crankshafts 30 and 44 do not have to be in co-axial alignment as previously stated and as hereinafter described in more detail.

The present invention also provides a phase angle control device 48 which serves as a power control device for the Stirling engine A. In this embodiment of the invention, the phase angle control device 48 comprises a first gear or bevel gear 50 connected to one end of the expander crankshaft 30 and a similar second gear or bevel gear 52 connected to the opposed end of the displacer crankshaft 44 in the manner where the two bevel gears 50 and 52 are spaced apart from each other and facing each other. A shiftable gear means in the form of a third bevel gear 54 is disposed in meshing engagement with the two bevel gears 50 and 52, in the manner as illustrated in FIGS. 1 and 4 of the drawings.

The third bevel gear 54 normally lies in a plane which is perpendicular to the planes in which the bevel gears 50 and 52 lie. Moreover, the bevel gear 54 can be shifted relative to the two bevel gears 50 and 52 through an arcuate path P, designated in FIG. 3 of the drawings. In this case, the arcuate path P has a center point which is coincident with the axis of rotation X of the expander crankshaft 30 and the displacer crankshaft 44. However, the radius of the arcuate path P is much greater than the radius of each of the crankshafts 30 and 44.

By reference to FIGS. 1 and 3 of the drawings, it can be observed that the expander crankshaft 30 and the bevel gear 50 rotate in a counter-clockwise direction, in the embodiment as illustrated. Thus, the displacer crankshaft 44 and the bevel gear 52 will rotate in a clockwise direction. As this occurs, the bevel gear 54 will also rotate in a counter-clockwise direction, reference being made to FIG. 1, so as to enable the two crankshafts 30 and 44 to rotate in timed relationship.

When it is desired to change the phase relationship between the expander portion and the displacer portion of the engine, in order to achieve a net power output from the engine, the bevel gear 54 is shifted along the arcuate path P. For this purpose, the bevel gear 54 may be connected to a shaft 56 which is, in turn, journaled in a bearing block 58 movable with the shaft 56. The bearing lock 58 must be shifted with the shaft 56 in order to permit movement of the bevel gear 54 and hence create a phase change between the two crankshafts 30 and 44.

FIG. 4 illustrates a shifted position of the bevel gear 54 through the arcuate path P to a position where a 20° change exists in the positive direction. For this purpose, a drum or cylindrically shaped disc or sleeve member 60 may be disposed between the two beveled gears 50 and 52 in the manner as illustrated in FIGS. 1 and 4. The drum 60, which functions as a piston displacement dial, may be mounted to the base plate of the engine or other non-moving structure. Moreover, each of the bevel gears 50 and 52 may be provided with phase indicator plates 62 on the surfaces facing each other. The phase indicator plates 62 may also be provided with pointers 64. In this way, it is possible to visually depict the achieved rotation of the bevel gear 54 relative to the bevel gears 50 and 52. When onsidering the shifting movement of the bevel gear 54 in FIG. 4 of the drawings, it can be observed that a positive 20° angle has been created between the displacer crankshaft 44 and the expander crankshaft 30 and hence a positive 20° phase angle shift between the expander portion 10 and the displacer portion 12 of the Stirling engine. This will cause a net forward power output in the power output shaft 46.

Reverse power output can also be obtained by shifting the bevel gear 54 in the opposite direction along the arcuate path P. Again, any desired amount of power output can be obtained merely by changing the phase angle between the expander portion and the displacer portion of the Stirling engine. In this respect, it can be observed that the phase angle can be changed even while the engine is running, and during engine operation at any particular speed. It should also be observed that since the two crankshafts 30 and 44 are rotating in opposite directions, twice the phase angle change is achieved by any movement of the gear 54. Thus a 20° movement of the gear 54 will cause a 40° phase angle change.

It can also be observed that the two portions of the Stirling engine are synchronized when the engine is not operating, merely by manually rotating the two gears 50 and 52 until the indicators 64 point to the 0 mark on the cylinder 60. As indicated previously, each of the beveled gears 50 and 52, and preferably the beveled gear 54, have the same size and the same number of teeth with the same teeth dimensions so as to maintain synchronization between the two portions of the engine.

FIGS. 5 and 6 illustrate another form of phase angle control device 70 utilizing a different differential type mechanism. The phase angle control device 70 comprises a first gear in the form of a spur gear 72, connected to one end, or at least in proximity to one end of the expander crankshaft 30. In like manner, a second gear in the form of a spur gear 74, is secured to an opposed end, or at least in proximity to an opposed end, of the displacer crankshaft 44. The spur gears 72 and 74 also have the same size and the same number of teeth.

The second gear 74 is disposed in meshing engagement with a third gear, or companion gear 76, which, in turn, rotates with a fourth gear 78, and which serves as a companion gear to the first gear 72. In this case, the third gear 76 and the fourth gear 78 are mounted on a common shaft 80 so as to cause rotation of the gears 76 and 78 with the shaft 80 in a synchronous manner. The fourth gear 78 is not disposed in meshing engagement with the first gear 72 but is spaced apart therefrom. However, the first gear 72 and the fourth gear 78 are rotated by means of an idler gear 82 which is mounted upon an idler crankshaft 84.

In accordance with the above outlined construction, when the shaft 80 is shifted about the axis of rotation of the two crankshafts 30 and 44, the phase angle between the two crankshafts 30 and 44 will be changed. Thus, movement in one direction will create a forward phase angle change, thus providing forward power output from the engine. Conversely, movement of the shaft 80 along with the gears 76 and 78 in the opposite direction will cause a reverse phase angle change, thereby providing a reverse power output from the engine.

In this respect, it can be observed that the phase angle control device 70 is similar to the previously described phase angle control device and operates in like manner. This phase angle control device 70 is another form of differential-type gear mechanism, which can also be used to change the phase angle between the expander portion and the displacer portion of the Stirling engine. Other differential type mechanisms can be used in the present invention including pinion gears and the like.

FIG. 7 more fully illustrates a more effective commercial form of phase angle control device 88 used in the Stirling engine of the present invention. In this case, the phase angle control device 88 includes an outer housing 90 having an enclosing side wall 91 and transverse end walls 92 with the crankshafts 30 and 44 extending through transverse end walls 92 of the housing. The expander crankshaft 30 is journaled in bearings 94 located against one transverse end wall 92 and a bearing 96 also mounted within the housing 90. In like manner, the displacer crankshaft 44 is similarly journaled in a bearing 98 located against one transverse end wall 92 of the housing 90 and another bearing 100 located within the housing and being secured to the interior thereof.

Each of the crankshafts 30 and 44 in the control device 88 are provided with the bevel gears 50 and 52 in the manner as illustrated in FIG. 1. Furthermore, it can also be observed that the two bevel gears 50 and 52 are connected together by means of a third bevel gear 54 disposed in meshing engagement therewith. In this case, the third bevel gear 54 is located on a shaft 102 which is in turn secured to the housing 90 and journaled in bearings 104 and 106 in the manner as illustrated in FIG. 7 of the drawings.

The housing 90 is also provided with an outer pair of longitudinally spaced apart bearing rings 108 which cooperate with bearing races or otherwise with a fixed wall 110 so that the entire housing may be rotated with respect to the crankshafts 30 and 34. For this purpose, the housing 90 is provided with an outwardly extending shaft 112. Thus, in order to change the phase angle between the displacer portion and the expander portion of the engine, it is only necessary to rotate the entire housing 90 by means of the shiftable movement of the shaft 112. For this purpose, it may be necessary to provide a power mechanism in order to shift the shaft 112 along with the housing 90.

In this respect, it can be observed that the phase angle control device, as illustrated in FIGS. 5 and 6 of the drawings, could function equally as well in the preferred commercial embodiment of FIG. 7, as opposed to the three bevel gear arrangement of differential-type mechanism.

It is not necessary to have the two crankshafts 30 and 44 in co-axial alignment, inasmuch as the crankshafts could be disposed at 90° with respect to each other or at other angles with respect to each other. It is only desirable to have the first and second gears, as, for example, the gears 50 and 52, mounted on shafts which are in co-axial relationship in order to utilize a differential-type gear mechanism of the present invention. Thus, any form of intermediate gear arrangement could be used to couple the two crankshafts in an arrangement such that the differential-type gear mechanism, which permits phase change, utilizes two gears, as, for example, the first and second gears 30 and 44, which are connected by shiftable gear means.

The Stirling engine of the present invention does not eliminate the necessity of varying the heat input to the engine to match the power required. However, this unique Stirling engine does allow the operation at full pressure and temperature for maximum efficiency at any speed and power output.

By reference to FIG. 8 of the drawings, it can be observed that at a phase angle differential of approximately +90°, the engine operates at full power in the forward direction, and at a phase angle of approximately −90°, the engine operates at a full power in the reverse direction. However, as the power output does increase, either in the forward or the reverse direction, after a certain level, as, for example, of about 25°, the efficiency and the brake thermal EMF of the engine does decrease somewhat. This is a problem inherent in hot gas engines and one which is not resolved by the present invention. Nevertheless, the Stirling engine of the present invention does provide an easy and economical means to vary the phase angle of the Stirling engine in order to provide either positive forward or reverse power output.

Thus, there has been illustrated and described, a unique and novel Stirling engine and a unique and novel phase relation control therefore, and which fulfills all of the objects and advantages sought therefore. It should be understood that many changes, modifications, variations and other uses and applications will become apparent to those skilled in the art after considering this specification and the accompanying drawings. Therefore, any and all such changes, modifications, variations, and other uses and applications which do not depart from the spirit and scope of the invention are deemed to be covered by the invention, which is limited only by the following claims.

Having thus described my invention, what I desire to claim and secure by Letters Patent is:

1. In a hot gas engine having a displacer member and an expander member with a displacer shaft section operatively connected to said displacer member and an expander shaft section operatively connected to said expander member, an improved means to control the phase angle between the displacer shaft section and the expander shaft section, said improved means comprising:

(a) a first gear on said displacer shaft section, (b) a second gear on said expander shaft section, (c) shiftable gear means including at least one gear in mating engagement with said first gear and mating engagement with said second gear permitting angular changing of the phase angle between said shaft section when said shiftable gear means is moved causing movement of said first and second gears, and (d) means operatively connected to said shiftable gear means which is manually operable to cause movement of said gear means in an arcuate path having a center point substantially coincident with the axis of each of said crankshafts for changing the phase angle between the shaft sections and the resultant power output of said engine, the amount of arcuate movement of said gear means being selectively determined by the operator of the engine to obtain the desired resultant power output so that said last named means can be moved for the selected amount through manual operation by the operator, and where said phase angle can be changed during operation of said engine and rotation of said crankshafts.

2. The improved means to control the phase angle in the hot gas engine of claim 1 in which said first and second gears are bevel gears and said at least one gear of said shiftable gear means is a connecting bevel gear.

3. The improved means to control the phase angle in the hot gas engine of claim 1 in which the movement of said shiftable gear means is a rotational movement causing rotation of said first and second gears and the respective first and second shaft sections in opposite directions.

4. The improved means to control the phase angle in the hot gas engine of claim 3 in which the shiftable gear means is movable in an arcuate path defined by a center-point coincident with the axis of rotation of said first and second shaft sections and a radius greater than the radius of said first and second shaft sections.

5. A hot gas engine comprising:

(a) a displacer member, (b) an expander member, (c) a displaced crankshaft operatively connected to said displacer member, (d) an expander crankshaft operatively connected to said expander member, (e) a first gear on said displacer crankshaft, (f) a second gear on said expander crankshaft, (g) a shiftable gear means including at least one gear in mating engagement with said first gear and mating engagement with said second gear permitting angular displacement between said crankshafts where said shiftable gear means is moved causing movement of said first and second gears, and (h) means operatively connected to said gear means which is manually operable to cause movement of said gear means in an arcuate path having a center point substantially coincident with the axis of each of said crankshafts for changing the phase angle between the crankshaft and the resultant power output of said engine, the amount of arcuate movement of said gear means being selectively determined by the operator of the engine to obtain the desired resultant power output so that said last named means can be moved for the selected amount through manual operation by the operator, and where said phase angle can be changed during operation of said engine and rotation of said crankshaft.

6. The hot gas engine of claim 5 in which said first and second gears are bevel gears and said at least one gear of said gear means is a third bevel gear.

7. The hot gas engine of claim 5 in which the movement of said shiftable gear means is a rotational movement causing rotation of said first and second gears and the respective first and second crankshaft in opposite directions.

8. The hot gas engine of claim 7 in which the shiftable gear means comprises a gear which is movable in an arcuate path defined by a centerpoint coincident with the axis of rotation of said first and second crankshafts and a radius greater than the radius of said first and second crankshafts.

9.

The hot gas engine of claim 5 in which an indicator member is located in relation to said first and second gears and said indicator member is provided with indicia to show the degree of rotation between said first and second crankshafts.

10. The improved means to control the phase angle in the hot gas engine of claim 5 in which an indicator member is located in relation to said first and second gears and said indicator member is provided with indicia to show the degree of rotation between said first and second shaft sections.

11. A hot gas engine comprising:

(a) an expander piston, (b) an expander crankshaft operatively connected to said expander piston and being rotated thereby, (c) a displacer piston, (d) a displacer crankshaft operatively connected to said displacer piston and being rotated thereby, (e) a power output shaft operatively connected to one of said expander crankshaft or displacer crankshaft, (f) differential gear means for changing the phase angle between said expander crankshaft and displacer crankshaft to thereby control the power output of said engine, said differential gear means comprising:

(1) an outer housing having a sidewall with a pair of opposite transverse ends, (2) bearing means interposed between said outer housing and a stationary structure to permit said outer housing to be rotatable about an axis passing through said opposite ends and with respect to said stationary structure, (3) a first gear in said housing and on a portion of said displacer crankshaft extending into said housing through one of the transverse ends, (4) a second gear in said housing and on a portion of said expander crankshaft extending into said housing through the other of the transverse ends, (5) a shiftable gear means in said housing and being movable with said housing, said shiftable gear means including at least one gear in operative mating engagement with said first gear and second gear permitting angular displacement between said crankshafts when said shiftable gear means is moved causing movement of said first and second gears, and (6) control means opertively connected to said housing and being manually actuable by an operator of said engine to cause rotation of same about an axis generally parallel to the axis of rotation of said first and second crankshafts, said rotation of said housing causing rotatable movement of said gear means relative to said first and second gears to adjustably control the phase angle between said expander crankshaft and displacer crankshaft and thereby control the resultant power output of the engine.

12. The hot gas engine of claim 11 in which said outer housing comprises end walls at each of the opposite transverse ends and said crankshafts extend through apertures in each of the respective end walls.

13. The hot gas engine of claim 11 in which said shiftable gear means is secured to said housing axis is movable in an arcuate path during rotational movement of said housing.

14. The hot gas engine in claim 11 in which first bearing means is located in said housing to journal one end of said expander crankshaft and second bearing means is located in said housing to journal one end of said displacer crankshaft.

15. The hot gas engine in claim 11 in which the axis of rotation of said housing is coincident with the axis of rotation of said crankshafts.

16. The hot gas engine of claim 11 in which said first and second gears are bevel gears and said at least one gear of said shiftable gear means is a connecting bevel gear.

17. The hot gas engine of claim 11 in which the amount of arcuate movement of said gear means being selectively determined by the operator of the engine to obtain the desired resultant power output so that said control means can be moved for the selected amount through manual operation by the operator, and where said phase angle can be changed during operation of said engine and rotation of said crankshafts.

18. In a hot gas engine having a displacer member and an expander member with a displacer crankshaft section operatively connected to said displacer member and an expander crankshaft section operatively connected to said expander member; an improved differential means to control the phase angle between the displacer shaft section and the expander shaft section, said improved means comprising:

(a) an outer housing having a sidewall with a pair of opposite transverse ends, (b) bearing means interposed between said outer housing and a stationary structure to permit said outer housing to be rotatable about an axis passing through said opposite ends and with respect to said stationary structure, (c) a first gear in said housing and on a portion of said displacer crankshaft section extending into said housing through one of the transverse ends, (d) a second gear in said housing and on a portion of said expander crankshaft section extending into said housing through the other of the transverse ends, (e) a shiftable gear means in said housing and being movable with said housing, said shiftable gear means including at least one gear in operative mating engagement with said first gear and second gear permitting angular displacement between said crankshaft sections when said shiftable gear means is moved causing movement of said first and second gears, and (f) control means operatively connected to said housing and being manually actuable by an operator of said engine to cause rotation of same about an axis generally parallel to the axis of rotation of said first and second crankshaft sections, said rotation of said housing causing rotatable movement of said gear means relative to said first and second gears to adjustably control the phase engine between said expander crankshaft section and displacer crankshaft section and thereby control the resultant power output of the engine.

19. The improved means of claim 18 in which said outer housing comprises end walls at each of the opposite transverse ends and said crankshaft sections extend through aperatures in each of the respective end walls.

20. The improved means of claim 18 in which said shiftable gear means is secured to said housing and is movable in an arcuate path during rotational movement of said housing.

21. The improved means of claim 18 in which first bearing means is located in said housing to journal one end of said expander crankshaft section and second bearing means is located in said housing to journal one end of said displacer crankshaft section.

22. The improved means of claim 18 in which the axis of rotation of said housing is coincident with the axis of rotation of said crankshaft sections.

23. A hot gas engine comprising:

(a) an engine casing having an expander cylinder and a displacer cylinder, (b) an expander piston shiftable in said expander cylinder, (c) an expander piston rod connected to and being movable with said expander piston, (d) a displacer piston shiftable in said displacer cylinder, (e) a displacer piston rod connected to and being movable with said displacer piston, (f) a crankcase secured to one end of said engine block and communicating with one end of the expander cylinder and one end of the displacer cylinder, (g) means associated with said expander piston rod to reduce side loads from being imparted thereto and guiding movement of said expander piston rod, (h) sealing means in said expander cylinder to prevent oil in said crankscase from entering into said expander cylinder beyond said expander piston but to maintain said expander cylinder at substantially the same pressure as said crankcase, (i) means associated with said displacer piston rod to prevent reduce side loads from being imparted thereto and guiding movement of said displacer piston rod, (j) sealing means in said displacer cylinder to prevent oil in said crankcase from entering into said displacer cylinder beyond said displacer piston but to maintain said displacer cylinder at substantially the same pressure as said crankcase, (k) a displacer crankshaft in said crankcase operatively connected to said displacer piston rod, (l) an expander crankshaft in said crankcase operatively connected to said expander piston rod, (m) a first gear on said displacer crankshaft, (n) a second gear on said expander crankshaft, (o) a shiftable gear means including at least one gear in mating engagement with said first gear and second gear permitting displacement between said crankshafts when said shiftable gear means is moved causing movement of said first and second gears, and (p) means operatively connected to said gear means which is manually operable to cause movement of said gear means in an arcuate path having a center point substantially coincident with the axis of each of said crankshafts to permit movement for changing the phase angle between the crankshaft and the resultant power output of said engine, the amount of arcuate movement of said gear means being selectively determined by the operator of the engine to obtain the desired resultant power output so that said least named means can be moved for the selected amount through manual operation by the operator, and where said phase angle can be changed during operation of said engine and rotation of said crankshafts.

24. The hot gas engine of claim 23 in which the movement of said shiftable gear means is a rotational movement causing rotation of said first and second gears and the respective first and second crankshafts in opposite directions.

25. The hot gas engine of claim 24 in which the shiftable gear means comprises a gear which is movable in an arcuate path defined by a centerpoint coincident with the axis of rotation of said first and second crankshafts and a radius greater than the radius of said first and second crankshafts.

* * * * *